US008056676B2

(12) United States Patent
Argoud

(10) Patent No.: US 8,056,676 B2
(45) Date of Patent: Nov. 15, 2011

(54) FALL-PREVENTION DEVICE DESIGNED TO INTERACT WITH A RIGID BELAY SUPPORT

(76) Inventor: Rodolphe Argoud, Laval (FR)

( * ) Notice: Subject to any disclaimer, the term of this patent is extended or adjusted under 35 U.S.C. 154(b) by 34 days.

(21) Appl. No.: 12/237,440

(22) Filed: Sep. 25, 2008

(65) Prior Publication Data

US 2009/0084630 A1 Apr. 2, 2009

(30) Foreign Application Priority Data

Sep. 27, 2007 (FR) ..... 07 06777

(51) Int. Cl.
*A62B 35/00* (2006.01)

(52) U.S. Cl. ..... 182/8; 182/36; 182/82; 182/239

(58) Field of Classification Search ..... 187/350–379; 182/8, 36, 82, 239
See application file for complete search history.

(56) References Cited

U.S. PATENT DOCUMENTS

| | | | | |
|---|---|---|---|---|
| 3,415,343 | A * | 12/1968 | Torbjorn Svensson | 187/270 |
| 3,934,682 | A * | 1/1976 | Hedstrom | 187/352 |
| 4,257,494 | A * | 3/1981 | Frankel | 187/373 |
| 4,606,430 | A * | 8/1986 | Roby et al. | 182/3 |
| 4,767,091 | A * | 8/1988 | Cuny | 248/228.4 |
| 4,934,660 | A * | 6/1990 | Nelson | 254/394 |
| 5,377,786 | A * | 1/1995 | Nakagawa | 187/287 |
| 6,457,569 | B2 * | 10/2002 | Draper et al. | 188/180 |
| 6,691,834 | B2 * | 2/2004 | Sanchez et al. | 187/373 |
| 6,725,969 | B1 * | 4/2004 | Meister | 182/8 |
| 2005/0082115 | A1 | 4/2005 | Petzl et al. | |
| 2008/0271961 | A1 * | 11/2008 | Noel | 187/373 |

FOREIGN PATENT DOCUMENTS

| | | |
|---|---|---|
| EP | 1 820 539 | 8/2007 |

* cited by examiner

*Primary Examiner* — Katherine Mitchell
*Assistant Examiner* — Daniel Cahn
(74) *Attorney, Agent, or Firm* — Cantor Colburn LLP

(57) ABSTRACT

This fall-prevention device comprises a body on which, mounted so as to rotate about a shaft, there is a wheel designed to press and roll on a belay support, and means for locking the body of the fall-prevention device on the belay support, the wheel comprising at least one centrifugal engagement device that can be moved between a disengaged position and an engaged position. The locking means comprise at least one locking member mounted so as to rotate on the body about the rotation shaft of the wheel, the locking member comprising a chock arranged to be inserted between the belay support and the wheel when the engagement device is in its engaged position, so as to immobilize the fall-prevention device on the belay support.

13 Claims, 7 Drawing Sheets

FALL-PREVENTION DEVICE DESIGNED TO INTERACT WITH A RIGID BELAY SUPPORT

TECHNICAL FIELD OF THE INVENTION

The present invention relates to a fall-prevention device designed to interact with a rigid belay support.

BRIEF DESCRIPTION OF RELATED ART

This type of fall-prevention device is designed to be used to secure a person moving along a rigid belay support, such as a support rail, attached for example to a building roof.

Document EP 1 820 539 describes such a fall-prevention device of the type comprising a body designed to be mounted so as to move along the belay support, and on which, mounted so as to rotate about a shaft, there is a wheel designed to press and roll on the belay support, and locking means that can move between a locked position in which the body of the fall-prevention device is immobilized on the belay support and an unlocked position in which the body of the fall-prevention device can move along the belay support, the wheel comprising at least a first centrifugal engagement device that can move between a disengaged position in which the locking means are in their unlocked position and do not interact with the first engagement device and a disengaged position in which the first engagement device interacts with the locking means and moves the latter into their locked position.

During a normal movement of a user connected via a carabiner to the fall-prevention device described in document EP 1 820 539, the wheel of the fall-prevention device presses and rolls on the belay support while the locking means are in their unlocked position. The result of this is that the fall-prevention device follows the progression of the user along the belay support without causing locking. The user is therefore free to move along the belay support.

When the user falls, the speed of the wheel rapidly increases because of gravity until it moves, by centrifugal effect, the engagement device into its engaged position, which causes a movement of the locking means into their locked position.

The result of this is an immobilization of the body of the fall-prevention device on the belay support, and therefore stopping the fall of the user.

The fall-prevention device described in document EP 1 820 539 has the following disadvantages.

The locking means of this fall-prevention device require the production of a large number of parts, which considerably increases the complexity and manufacturing costs of the device, and the time for assembling the latter.

The locking means of this fall-prevention device allow no progressiveness in the locking action. The latter being achieved by the insertion of a catch into a hole arranged in the belay support.

BRIEF SUMMARY OF THE INVENTION

The invention remedies these disadvantages supplies a fall-prevention device that has a simple and economic structure, while allowing easy and rapid assembly of the fall-prevention device.

Accordingly, the present invention relates to a fall-prevention device of the aforementioned type, wherein the locking means comprise at least a first locking member mounted so as to be able to rotate on the body about the rotation shaft of the wheel, the first locking member comprising a chock arranged to be inserted between the belay support and the wheel when the first engagement device is in its engaged position, so as to immobilize the fall-prevention device on the belay support.

Producing the locking means in one piece makes it possible to reduce the costs of manufacture of the fall-prevention device, and the time of assembly of the latter.

According to one feature of the invention, the first locking member comprises at least one stop designed to interact with the first engagement device when the latter is in its engaged position, for the rotation of the first locking member by the wheel.

According to another feature of the invention, the first locking member is held in its unlocked position by an elastic means placed between the body and the first locking member.

Advantageously, the centrifugal engagement device is placed in a housing arranged in the wheel, and the first locking member forms a wall for closing off this housing.

Preferably, the chock extends substantially over a cylinder segment with an axis indistinguishable from the axis of rotation of the locking member.

Advantageously, the chock has a substantially wedge-shaped section.

According to another feature of the invention, the chock comprises anchoring roughnesses designed to interact with the belay support.

Preferably, the first centrifugal engagement device comprises at least one weight mounted so as to pivot about a shaft secured to the wheel and extending substantially parallel to the rotation shaft of the wheel between a disengaged position in which the weight does not interact with the stop placed on the first locking member and an engaged position in which the weight interacts with this stop.

Advantageously, the weight is held in its disengaged position by means of an elastic means placed between the wheel and the weight.

According to one feature of the invention, the wheel comprises a second centrifugal engagement device operating in the reverse direction to the first centrifugal engagement device, and the locking means comprise a second locking member mounted so as to rotate on the body about the rotation shaft of the wheel, the first locking member being designed to immobilize the body of the non-return device when the latter moves in a first direction along the belay support, and the second locking member being designed to immobilize the body of the non-return device when the latter moves in a second direction opposite to the first direction.

These arrangements make it possible to obtain a fall-prevention device that is reversible, that is to say able to achieve a locking of a user's fall in two opposite directions, which is advantageous when the belay support follows a route comprising sections of different orientations, as may be the case on a roof with several faces.

Preferably, the fall-prevention device comprises guide rollers mounted so as to rotate on the body and arranged to interact with the belay support.

BRIEF DESCRIPTION OF THE DRAWINGS

In any case, the invention will be well understood with the aid of the following description, with reference to the indexed schematic drawing representing, as a nonlimiting example, one form of execution of this fall-prevention device.

DETAILED DESCRIPTION OF THE INVENTION

Figure 1:
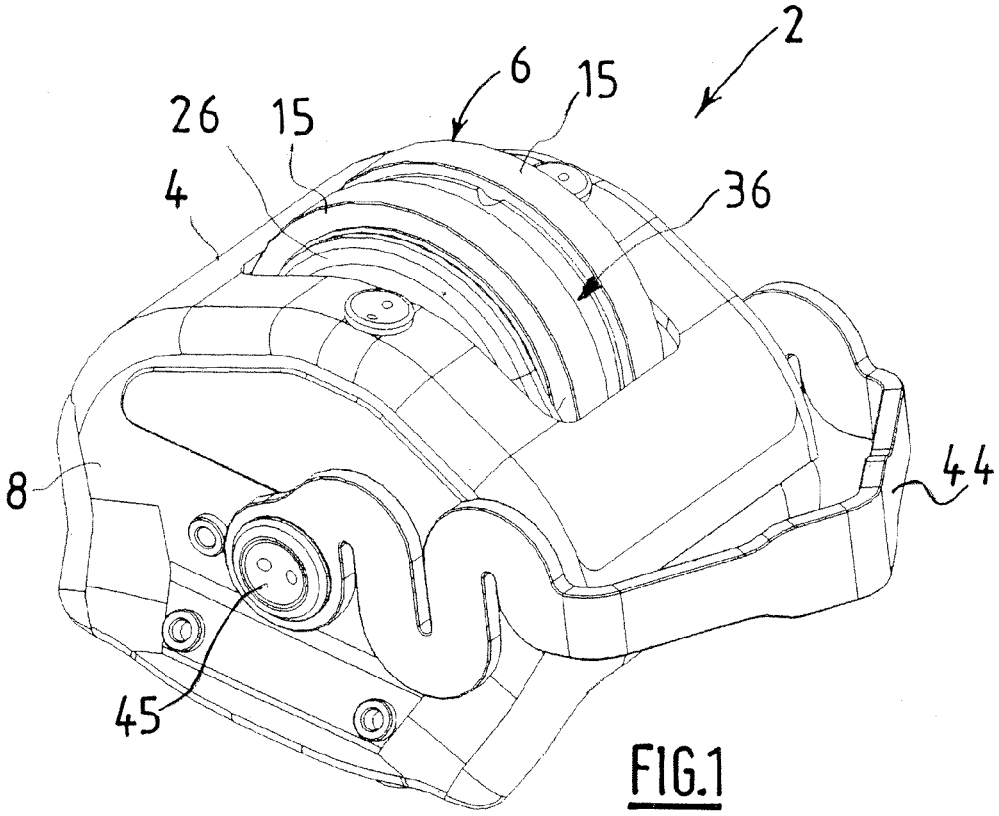
FIG. 1 is a view thereof in perspective from above.
Figure 2:
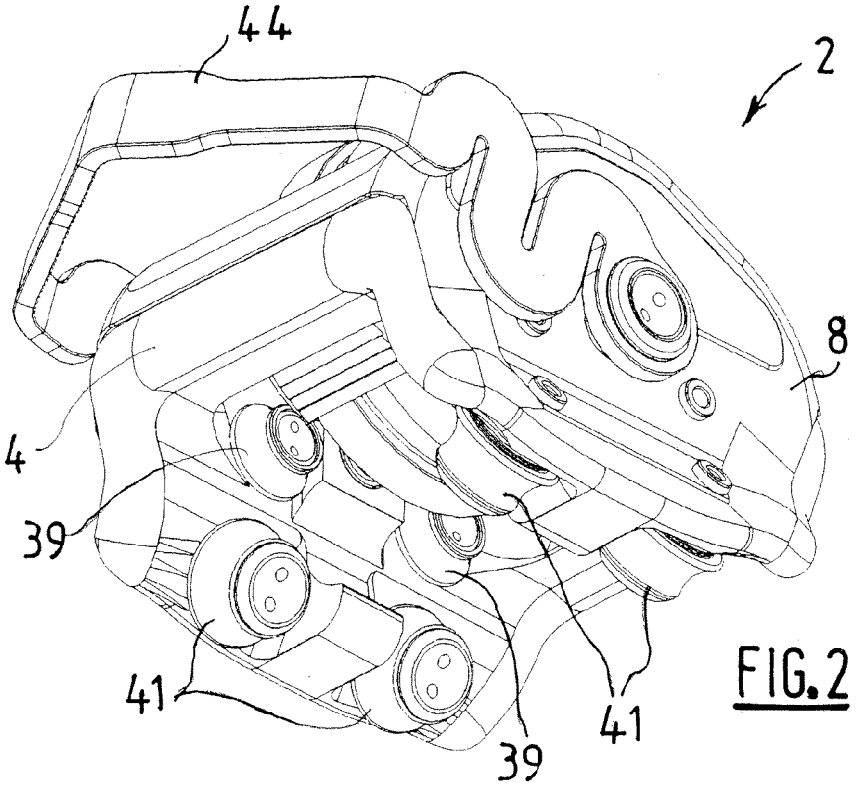
FIG. 2 is a view thereof in perspective from below.

FIGS. 1 to 5 represent a fall-prevention device 2 designed to interact with a rigid belay support, such as a support rail 3.

The fall-prevention device 2 comprises a body 4 designed to be mounted so as to move along the belay support 3 and on which, mounted so as to rotate about a shaft 5, is a wheel 6 designed to press and roll on the belay support 3.

Figure 5:
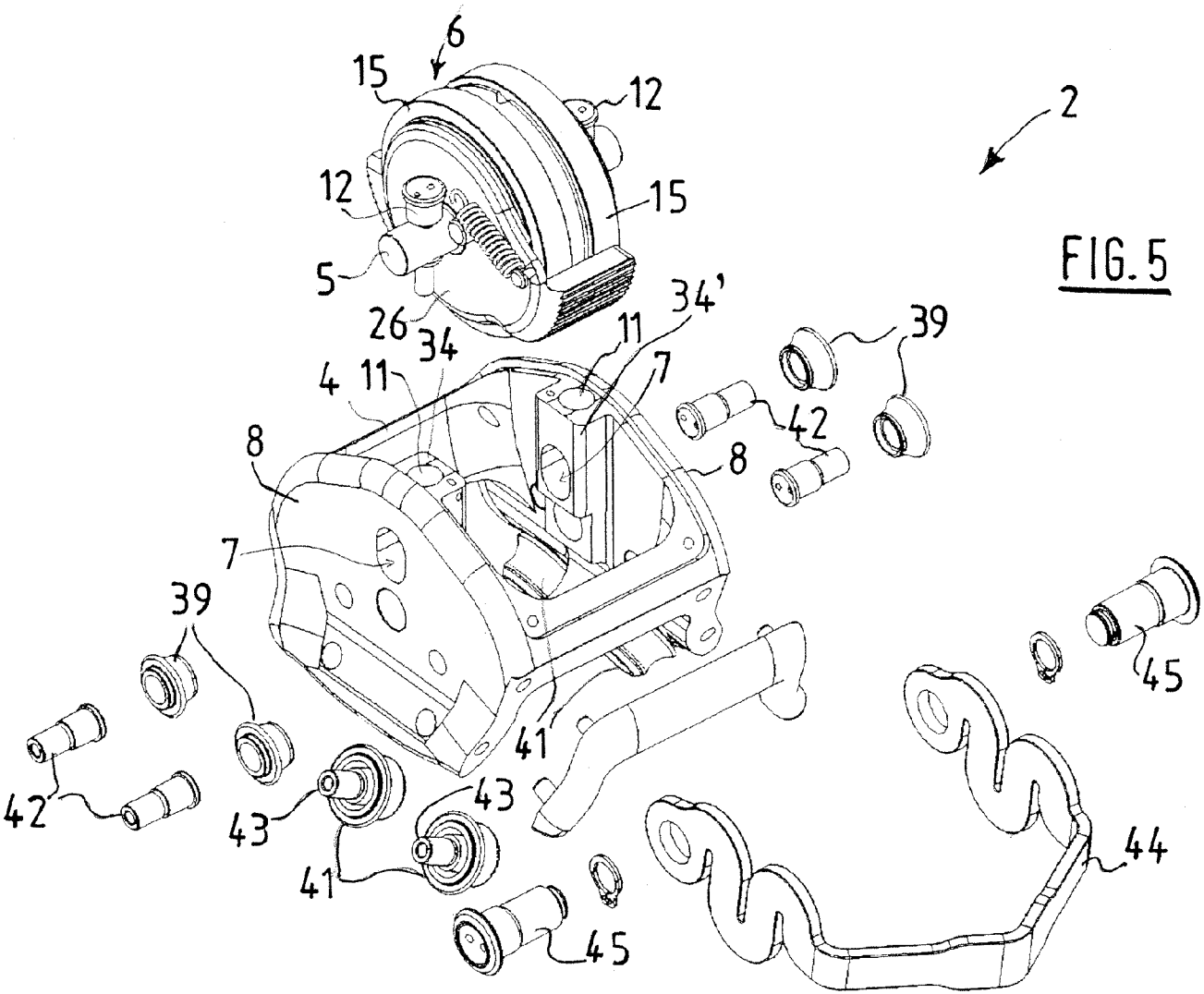
FIG. 5 is an exploded view thereof in perspective.
Figure 6:
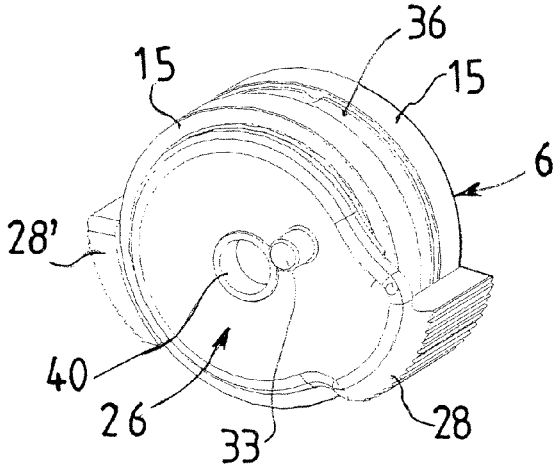
FIG. 6 is a view in perspective of the wheel of the fall-prevention device of FIG. 1.
Figure 7:
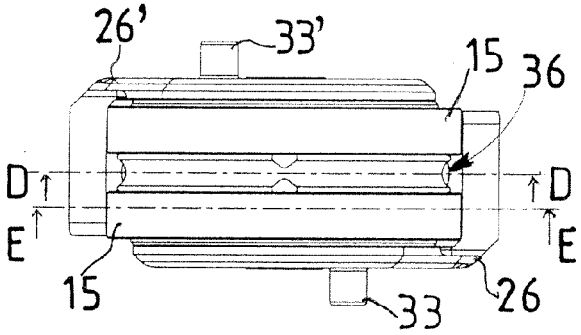
FIG. 7 is a view from above of the wheel of FIG. 5.
Figure 8:
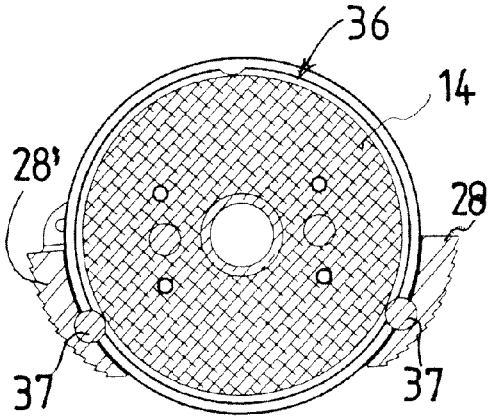
FIG. 8 is a view in section along the line D-D of FIG. 6.

As shown more particularly in FIG. 5, the shaft 5 is mounted in two oblong openings 7 arranged in the lateral walls 8 of the body 4.

The shaft 5 comprises on either side of the wheel 6 two through bores 9, the two through bores 9 being smooth and extending perpendicularly to the shaft 5. The shaft 5 also comprises two smooth pins 10 screwed into the through bores 9.

The body 4 comprises two tapped bores 11 arranged in its lateral walls 8, the two tapped bores 11 extending perpendicularly to the shaft 5. Each through bore 9 arranged in the shaft 5 is designed to be placed opposite one of the bores 11.

The fall-prevention device 2 also comprises two screws 12 screwed into the bores 9 arranged in the shaft 5.

It should be noted that two compression springs 13 are placed respectively between the shaft 5 and the screws 12, the ends of the springs being in contact respectively with the shaft and the associated screws.

Therefore, the shaft 5 may move in translation in the oblong openings 6 arranged in the body 4.

Figure 3:
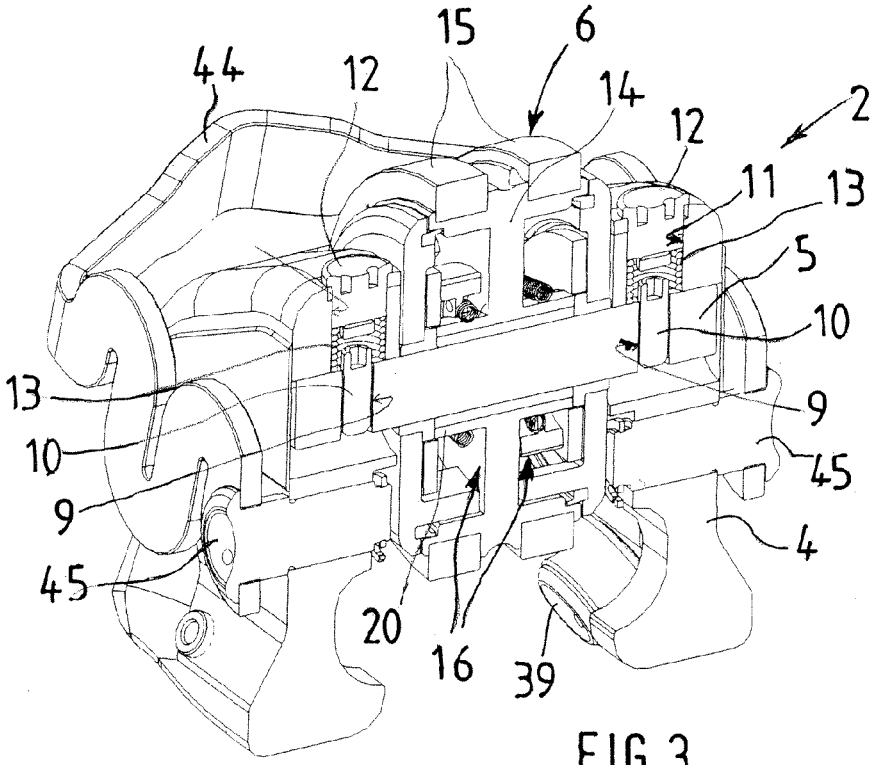
FIG. 3 is a view thereof in section, in perspective.
Figure 4:
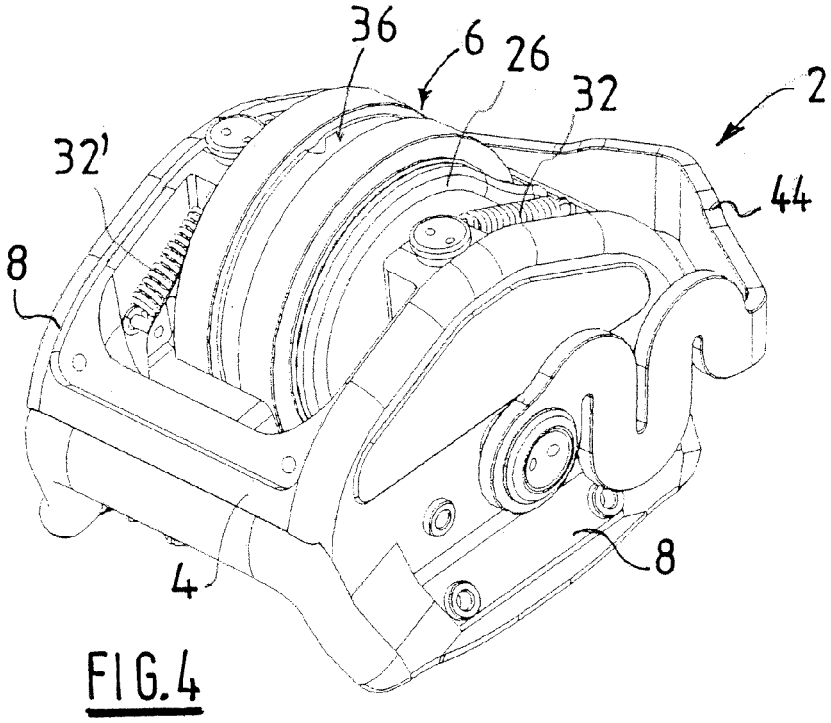
FIG. 4 is a view thereof in perspective in which the cover for protection of the body is removed.

As shown more particularly in FIG. 3, the body 14 of the wheel 6 has a substantially I-shaped section and comprises two treads 15 made of synthetic material such as a polyurethane.

The body 14 of the wheel 6 delimits two cylindrical lateral housings 16 in which are mounted respectively two centrifugal engagement devices 17, 17' operating in the reverse direction.

Figure 9:
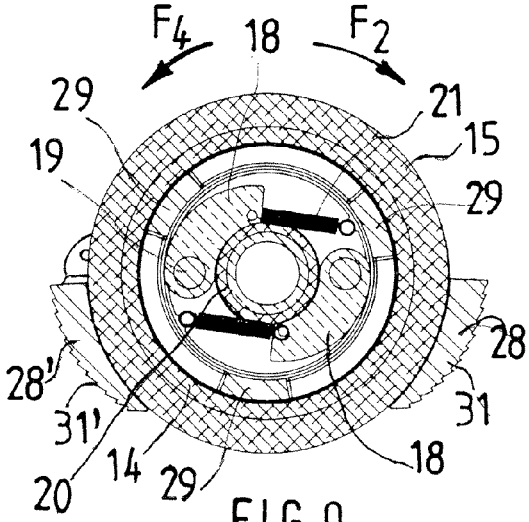
FIG. 9 is a view in section along the line E-E of FIG. 6.
Figure 10:
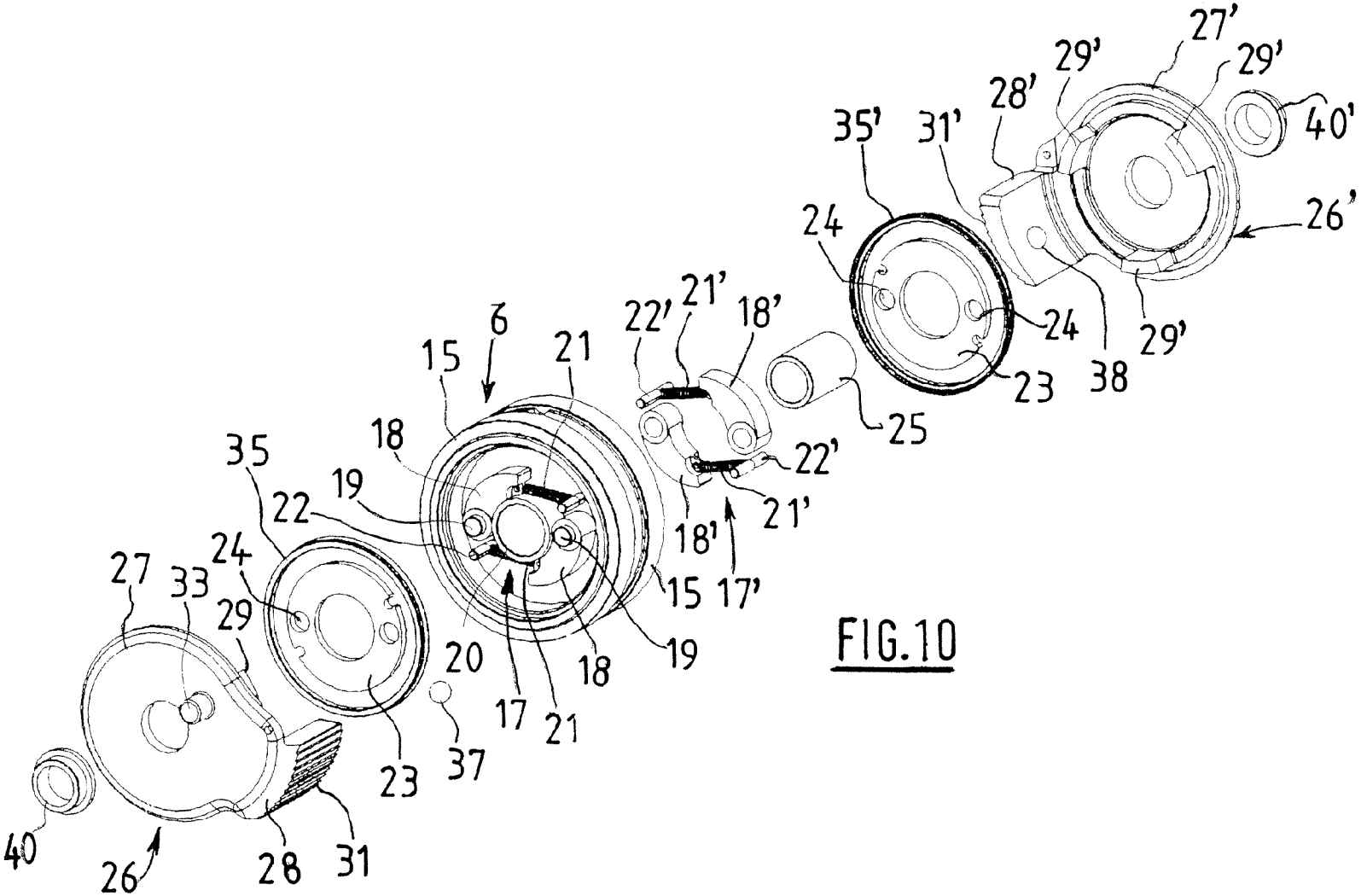
FIG. 10 is an exploded view in perspective of the wheel of FIG. 5.

As shown in FIGS. 9 and 10, each centrifugal engagement device 17, 17' comprises two weights 18, 18' mounted so as to pivot relative to the body 14 of the wheel 6. Each weight 18, 18' is mounted so as to pivot about a shaft 19 secured to the body 14 of the wheel 6 and extending parallel to the shaft 5 between a disengaged position in which the weight 18, 18' is in contact with the hub 20 of the wheel 6 and an engaged position in which the weight 18, 18' is separated from the hub 20 by a centrifugal effect.

Each weight 18, 18' is held in its disengaged position by virtue of a tension spring 21, 21' whose ends are respectively attached to the weight 18, 18' and to a pin 22, 22' secured to the body of the wheel.

The wheel 6 also comprises two shims 23 for retaining the weights 18, 18'. Each shim 23 comprises two orifices 24 designed to interact with the pivot shafts 19 of the weights so as to allow the attachment of the corresponding shim to the body 14 of the wheel.

It should be noted that the body 14 of the wheel 6 is guided in rotation relative to the shaft 5 by means of a bush 25.

The fall-prevention device 2 also comprises two identical locking members 26, 26' mounted so as to rotate on the body 4 about the shaft 5. Each locking member 26, 26' can be moved between a locked position in which the body 4 of the fall-prevention device is immobilized on the belay support 3 and an unlocked position in which the body 4 of the fall-prevention device can be moved along the belay support.

Each locking member 26, 26' is designed to interact with one of the centrifugal engagement devices 17, 17'.

Consequently, the locking members 26, 26' are placed respectively on either side of the body 14 of the wheel 6.

Each locking member 17, 17' comprises a first substantially annular portion 27, 27' designed to form a wall for closing off the housing 16 in which the corresponding engagement device 17, 17' is mounted, and a second portion 28, 28' extending perpendicularly to the first portion.

As shown in FIGS. 9 and 10, the first portion 27, 27' of each locking member 26, 26' comprises, on its face turned toward the wheel 6, three drive lugs 29, 29' forming a stop evenly distributed about the shaft 5.

The drive lugs 29, 29' are designed to interact with the weights 18, 18' of the corresponding engagement device 17, 17' when the latter are in their engaged position so as to allow the corresponding locking member 26, 26' to be driven in rotation by the wheel 6.

The second portion 28, 28' of each locking member 26, 26' forms a chock extending substantially over a segment of a cylinder with a shaft indistinguishable from the shaft 5.

The chock 28, 28' has a substantially wedge-shaped section and comprises, on its surface turned toward the outside, anchoring teeth 31, 31' designed to interact with the outer surface of the belay support 3.

The chock 28, 28' of each locking member 26, 26' is arranged to be inserted between the belay support 3 and the wheel 6 when the associated locking member 26, 26' is rotated by the wheel 6.

Each locking member 26, 26' is held in its unlocked position by means of a tension spring 32, 32' whose ends are respectively attached to the body 4 and to the first portion 27, 27' of this locking member 26, 26', and a lug forming a stop 33, 33' arranged on the face of its first portion 27, 27' opposite to the wheel 6 and pressing against a protruding portion 34, 34' arranged on the inner surface of the corresponding lateral wall 8 of the body 4.

It should be noted that the locking members 26, 26' are guided in rotation relative to the shaft 5 by means of two bushes 40, 40'.

The fall-prevention device 2 also comprises two annular seals 35, 35' placed between the locking members 26 and 26' and the wheel 6 so as to seal the housings 16 in which the centrifugal engagement devices 17, 17' are mounted.

It should be specified that the wheel 6 comprises an annular track 36 arranged between the two treads 15 and designed to interact with two ball bearings 37 accommodated in two housings 38 arranged respectively in the faces of the chocks 28, 28' turned toward the wheel 6.

The fall-prevention device 2 also comprises guide rollers 39, 41 mounted so as to rotate on the body 4 and arranged to interact with the belay support 3.

The body 4 comprises, on each of its lateral walls 8, two guide rollers 39 mounted so as to rotate about shafts 42 parallel to the shaft 5 and two guide rollers 41 mounted so as to rotate about shafts 43 oriented at 45° relative to the shaft 5.

The fall-prevention device 2 also comprises a coupling clamp 44 whose branches are mounted so as to pivot about two shafts 45 secured respectively to the lateral walls 8 of the body 4. The coupling clamp 44 allows a user wearing a baldric to secure himself to the fall-prevention device 2 by coupling a carabiner connected to his baldric to the coupling clamp 44.

It should be noted that the branches of the coupling clamp 44 are designed to deform when a high tension force is exerted on the coupling clamp 44, so as to absorb an impact when a user falls.

Figure 11:
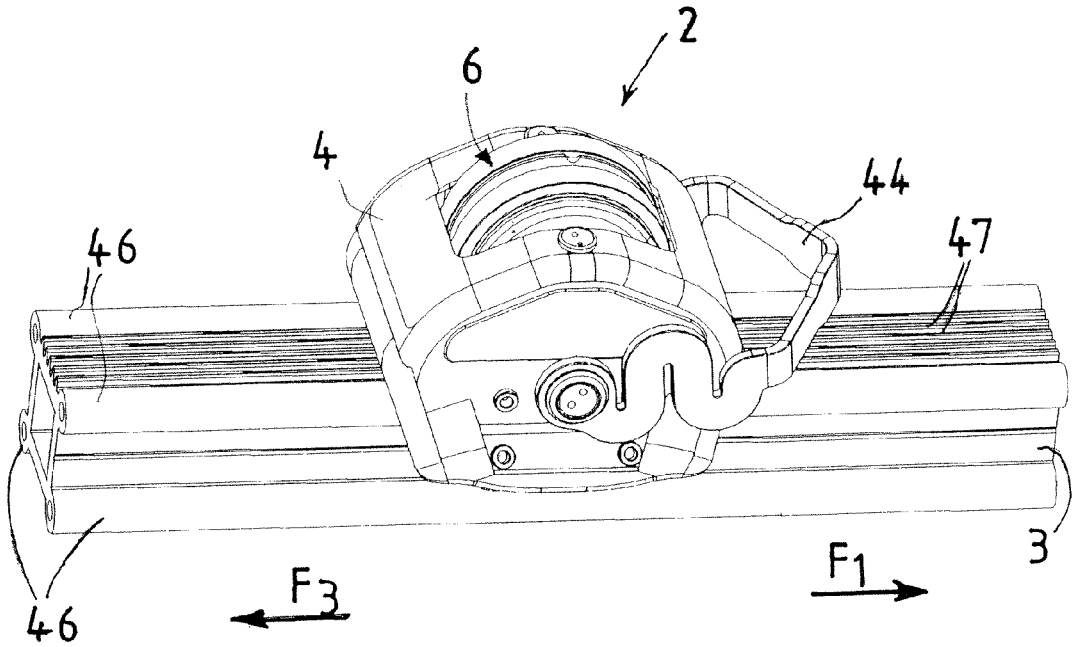
FIG. 11 is a view in perspective of the fall prevention device of FIG. 1 mounted on a support rail.
Figure 12:
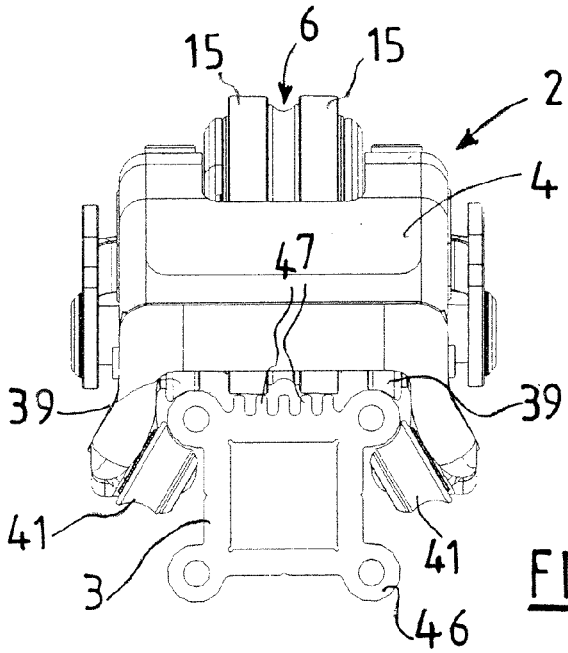
FIG. 12 is a front view of FIG. 10.
Figure 13:
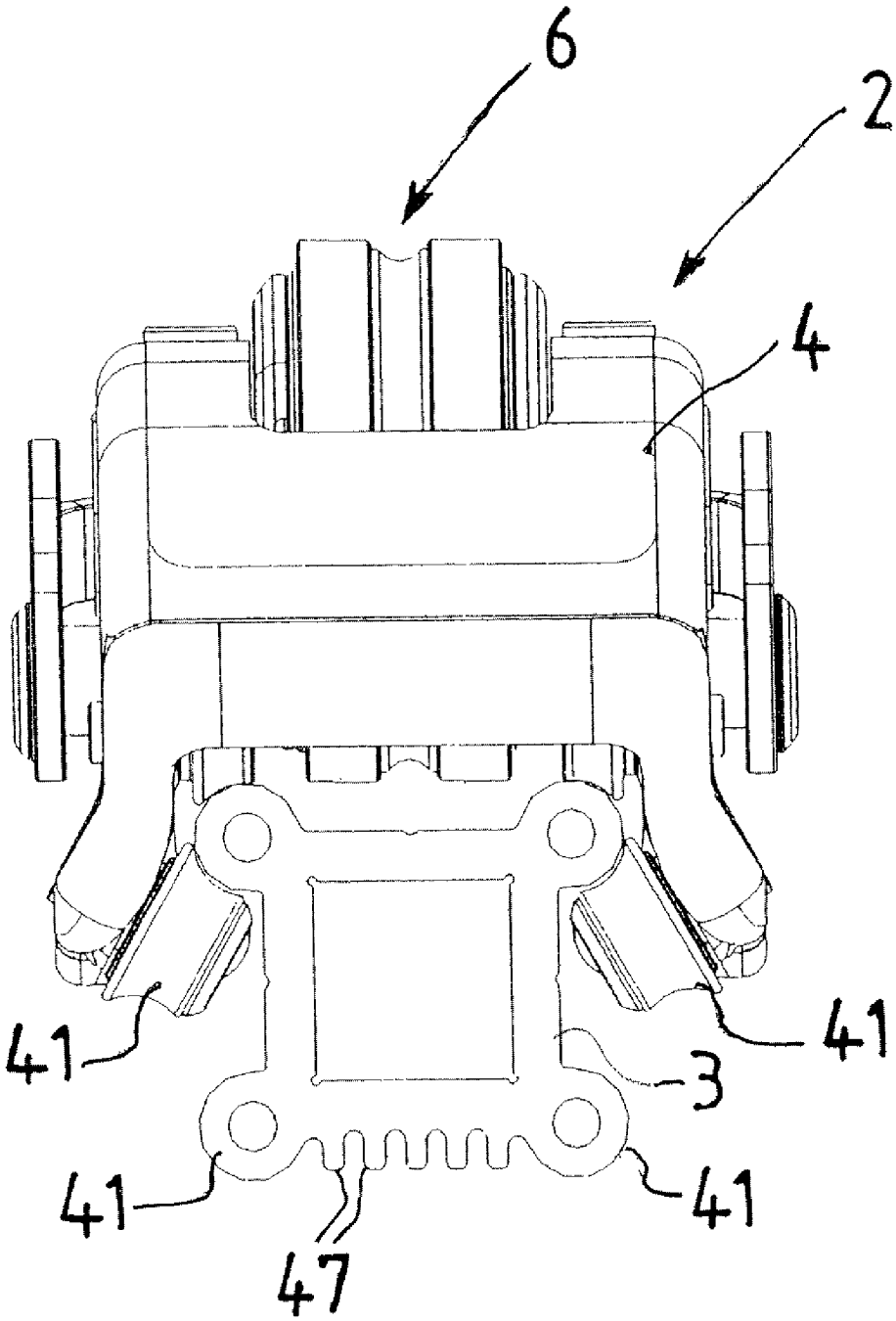
FIG. 13 is a front view of the fall-prevention device of FIG. 1 mounted on the support rail of FIG. 11 according to another method of positioning.

FIGS. 11 and 12 show the fall-prevention device mounted on a support rail 3 of substantially square section. The support rail 3 has, on its edges, guide ribs 46 of circular section designed to interact with the guide rollers 39, 41 of the fall-prevention device.

It should be noted that the positioning and shape of the guide rollers and the guide ribs ensure that the fall-prevention device 2 is held on the support rail 3.

The support rail 3 comprises, on one of its faces, longitudinal ribs 47 on which the wheel 6 of the fall-prevention device 2 is designed to press and roll.

The operation of the fall-prevention device will now be described.

During a normal movement of a user connected by means of a carabiner to the fall-prevention device 2, the wheel 6 presses and rolls on the ribs 47 of the support rail 3 at a speed that is insufficient to move the weights 18, 18' of the engagement devices 17, 17' into their engaged position, so the latter are held in their disengaged position by the corresponding tension springs 21, 21'.

Therefore, as shown in FIG. 9, the weights 18, 18' cannot interact with the drive lugs 29, 29' arranged on the corresponding locking member 26, 26'.

Consequently, the locking members 26, 26' are not rotated by the wheel 6 and are therefore held in their unlocked position by the associated tension springs 32, 32'.

The result of this is that the fall-prevention device 2 follows the progression of the user along the support rail without locking.

When the user falls causing the fall-prevention device 2 to move in the direction of the arrow F1 shown in FIG. 11, the wheel 6 is rotated in the direction of the arrow F2 shown in FIG. 9. The fall of the user, because of gravity, greatly increases the speed of rotation of the wheel 6. The weights 18 of the centrifugal engagement device 17 designed to interact with the locking member 26 are then subjected to a centrifugal force that is greater than and in the opposite direction to the return force of the associated springs 21. The result of this is that the weights 18 separate from the hub 20 of the wheel 6 and move into their engaged position. The free ends of the weights 18 therefore come into contact with the drive lugs 29 arranged on the inner face of the first portion 27 of the locking member 26, which causes the locking member 26 to be rotated in the direction of the arrow F2. The chock 28 of the locking member 17 is therefore inserted between the treads 15 of the wheel 6 and the ribs 47 arranged on the support rail so as to immobilize the body 4 on the support rail 3. The presence of the anchoring teeth 31 arranged on the outer surface of the chock increases the wedge effect, and consequently improves the immobilization of the body 4 on the support rail 3.

It should be noted that the weights 18' of the engagement device 17' designed to interact with the locking member 26' cannot move into their engaged position when the fall-prevention device 2 moves at high speed in the direction of the arrow F1. Specifically, in this case, the effect of the centrifugal force is to press the weights 18' against the hub 20 of the wheel 6 because the engagement device 17' operates in the opposite direction to the engagement device 17.

Naturally, when a user falls causing a movement of the fall-prevention device 2 in the direction of the arrow F3 shown in FIG. 11, the wheel 6 is rotated in the direction of the arrow F4 shown in FIG. 9. In this case, the weights 18' of the centrifugal engagement device 17' designed to interact with the locking member 26' are then subjected to a centrifugal force that is greater than and in the opposite direction to the return force of the associated springs 21', which causes the weights 18' to move into their engaged position and therefore moves the chock 28' in the direction of the arrow F4 until it is inserted between the ribs 47 of the support rail 3 and the treads 15 of the wheel 6.

It should be noted that, when the roof of a building is substantially flat, a user may move without danger at a speed greater than that allowing the movement of the weights of one of the engagement devices into their engaged position. The result of this is that the fall-prevention device may be immobilized on the support rail 3 if the user is moving at too great a speed. Consequently, the user is not free to move along the support rail 3 at the speed that he wishes.

In order to allow a user to be able to move at great speed in zones having a slight slope (<15°), it is preferable, in these zones, to place the support rail 3 so that the ribs 47 of the latter are opposite to the wheel 6 of the fall-prevention device.

Accordingly, in the event of movement of the weights of one of the engagement devices into their engaged position, and therefore in the event that the corresponding locking member moves into its locked position, the chock of this locking member cannot interact with the support rail 3 and therefore immobilize the fall-prevention device 2 on the latter.

As a result, the user can, in not very dangerous zones, move rapidly without risking being stopped by the fall-prevention device.

As it goes without saying, the invention is not limited to the form of execution of this fall-prevention device described above as an example; on the contrary, it covers all the variant embodiments thereof.

The invention claimed is:

1. A fall-prevention device designed to interact with a rigid belay support, the fall-prevention device comprising a body movably mounted the belay support and on which, mounted to rotate around a central longitudinal axis of a shaft, there is a wheel to press and roll on the belay support, and a locking device to move between a locked position in which the body of the fall-prevention device is immobilized on the belay support and an unlocked position in which the body of the fall-prevention device is movable along the belay support, the wheel comprising at least a first centrifugal engagement device to move between a disengaged position in which the locking device is in the unlocked position and does not interact with the first engagement device and an engaged position in which the first engagement device interacts with the locking device and moves the locking device into the locked position, wherein the locking device comprises at least a first locking member mounted to rotate on the body around the central longitudinal axis of the shaft of the wheel independently from the wheel, the first locking member comprising a chock arranged to be inserted between the belay support and the wheel when the first engagement device is in the engaged position to immobilize the fall-prevention device on the belay support.

2. The fall-prevention device as claimed in claim 1, wherein the first locking member comprises at least one stop to interact with the first engagement device when the first engagement device is in the engaged position.

3. The fall-prevention device as claimed in claim 1, wherein the first locking member is held in the unlocked position by an elastic member.

4. The fall-prevention device as claimed in claim 1, wherein the centrifugal engagement device is placed in a housing, with the housing arranged in the wheel, and wherein the first locking member forms a wall for closing off the housing.

5. The fall-prevention device as claimed in claim 1, wherein the chock extends substantially over a cylinder segment with an axis substantially similar to the central longitudinal axis of the shaft.

6. The fall-prevention device as claimed in claim 1, wherein the chock has a substantially wedge-shaped section.

7. The fall-prevention device as claimed in claim 1, wherein the chock comprises an anchoring roughness to interact with the belay support.

8. The fall-prevention device as claimed in claim 2, wherein the first centrifugal engagement device comprises at least one weight mounted to pivot around a wheel shaft secured to a body of the wheel and extending substantially parallel to the central longitudinal axis of the shaft between a disengaged position in which the weight does not interact with the stop and an engaged position in which the weight interacts with the stop.

9. The fall-prevention device as claimed in claim 8, wherein the weight is held in the disengaged position by an elastic member.

10. The fall-prevention device as claimed in claim 1, wherein the wheel comprises a second centrifugal engagement device operating in a reverse direction to the first centrifugal engagement device, and wherein the locking device comprises a second locking member mounted to rotate on the body around the central longitudinal axis of the shaft.

11. The fall-prevention device as claimed in claim 1, which comprises guide rollers mounted to rotate on the body and arranged to interact with the belay support.

12. A fall-prevention device, comprising:

a body movable along a belay support and on which a wheel to press and roll on the belay support is mounted to rotate around a central longitudinal axis of a shaft; and a locking device movable between locked and unlocked positions in which the body is immobilized and mobilized, respectively, on the belay support, the wheel comprising:

an engagement device movable between a disengaged position in which the locking device is in the unlocked position and an engaged position in which the engagement device moves the locking device into the locked position, wherein the locking device comprises a first locking member rotatable on the body, with rotation of the first locking member being defined round the central longitudinal axis of the rotation shaft of the wheel, and wherein the first locking member includes a chock inserted between the belay support and the wheel when the engagement device is in the engaged position.

13. A fall-prevention device, comprising:

a belay support extending in a longitudinal direction;

a body movable along the belay support in the longitudinal direction, which is constrained from moving away from the belay support in a direction transverse to the longitudinal direction, a wheel mounted on the body to press and roll on the belay support in accordance with a rotation of the wheel around a central longitudinal axis of a shaft; and a locking device movable between locked and unlocked positions in which the body is immobilized and mobilized, respectively, on the belay support, the wheel comprising:

an engagement device movable between a disengaged position in which the locking device is in the unlocked position and an engaged position in which the engagement device moves the locking device into the locked position, wherein the locking device comprises a first locking member rotatable on the body, with rotation of the first locking member being defined around the central longitudinal axis of the rotation shaft of the wheel, and wherein the first locking member includes a chock inserted between the belay support and the wheel when the engagement device is in the engaged position.

* * * * *